United States Patent [19]

Andersen

[11] 4,249,069

[45] Feb. 3, 1981

[54] FLASK HEATER ASSEMBLY

[75] Inventor: M. Leland Andersen, Loveland, Colo.

[73] Assignee: Hach Chemical Company, Loveland, Colo.

[21] Appl. No.: 883,206

[22] Filed: Mar. 3, 1978

[51] Int. Cl.[3] ..... H05B 3/58

[52] U.S. Cl. ..... 219/535; 219/345; 219/385; 219/424; 219/436; 219/433; 219/521; 219/546; 338/280; 338/285

[58] Field of Search ..... 219/216, 385, 386, 424, 219/430, 432, 433, 436, 437, 516, 521, 530, 535, 543, 546; 338/279, 280, 283, 285, 297

[56] References Cited

U.S. PATENT DOCUMENTS

| | | | |
|---|---|---|---|
| 1,028,107 | 6/1912 | Hanaway et al. | 219/436 |
| 1,236,642 | 8/1917 | Abtmeyer et al. | 219/535 X |
| 1,535,307 | 4/1925 | Hawk | 219/436 X |
| 1,737,460 | 11/1929 | Johnson | 219/535 X |
| 2,029,075 | 1/1936 | Knight | 219/535 |
| 2,572,695 | 10/1951 | Briscoe et al. | 219/535 |
| 2,607,876 | 8/1952 | Bergen et al. | 219/535 |
| 2,643,324 | 6/1953 | Goldstaub | 219/535 X |
| 2,680,305 | 6/1954 | Reed | 219/535 X |
| 3,654,429 | 4/1972 | Strachan | 219/346 |
| 3,971,912 | 7/1976 | Krüger et al. | 219/216 |

FOREIGN PATENT DOCUMENTS

| | | | |
|---|---|---|---|
| 939664 | 10/1963 | United Kingdom | 219/535 |

*Primary Examiner*—Volodymyr Y. Mayewsky
*Attorney, Agent, or Firm*—Leydig, Voit, Osann, Mayer & Holt, Ltd.

[57] ABSTRACT

A flask heater assembly for spherical bodied, boiling flasks in which a block is hollowed to receive the flask body and a ribbon of electrical resistance heated, flexible metal is folded into an elongated band and bent and fitted into the hollow to conform with the shape of the flask. A reduced voltage current is supplied to the ends of the ribbon to produce a temperature on the order of 400° C., i.e., well below the glow temperature of the metal.

1 Claim, 4 Drawing Figures fig. 2.
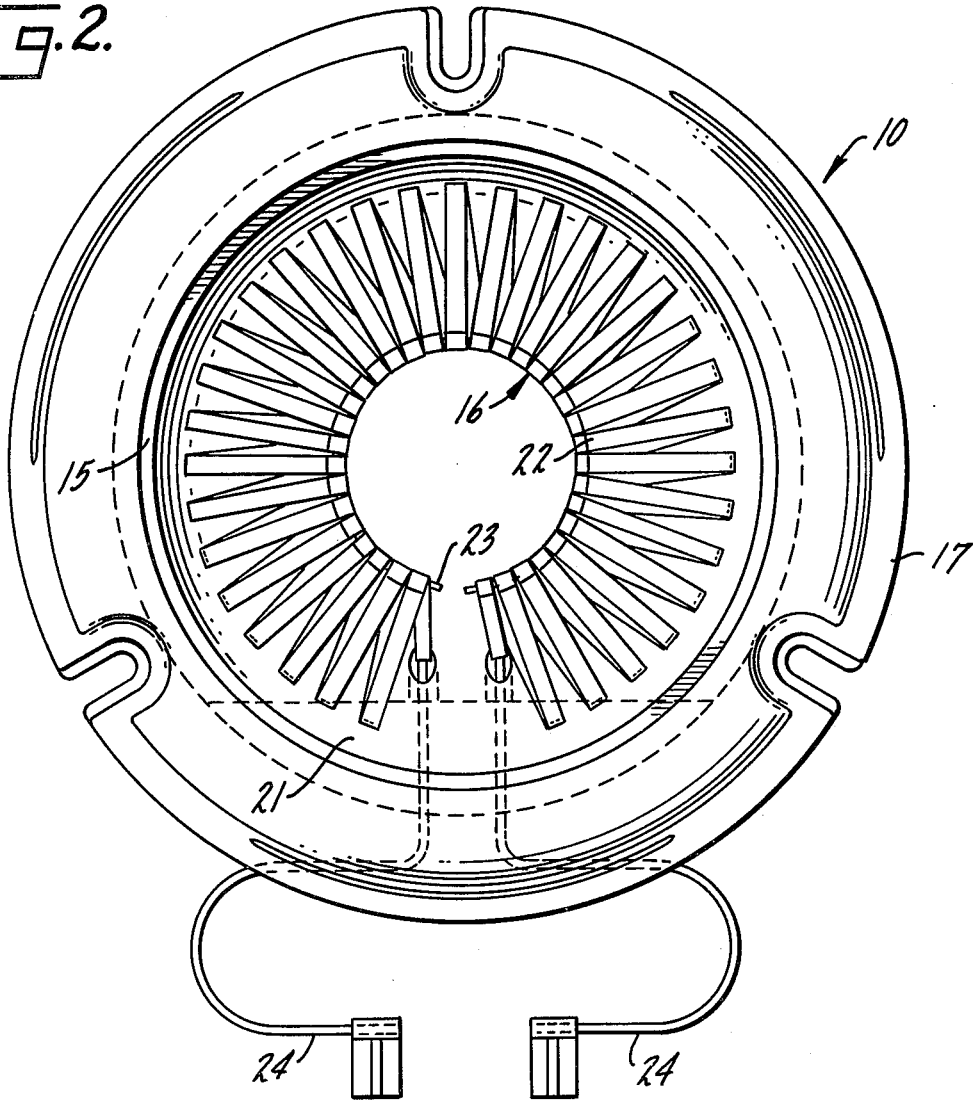
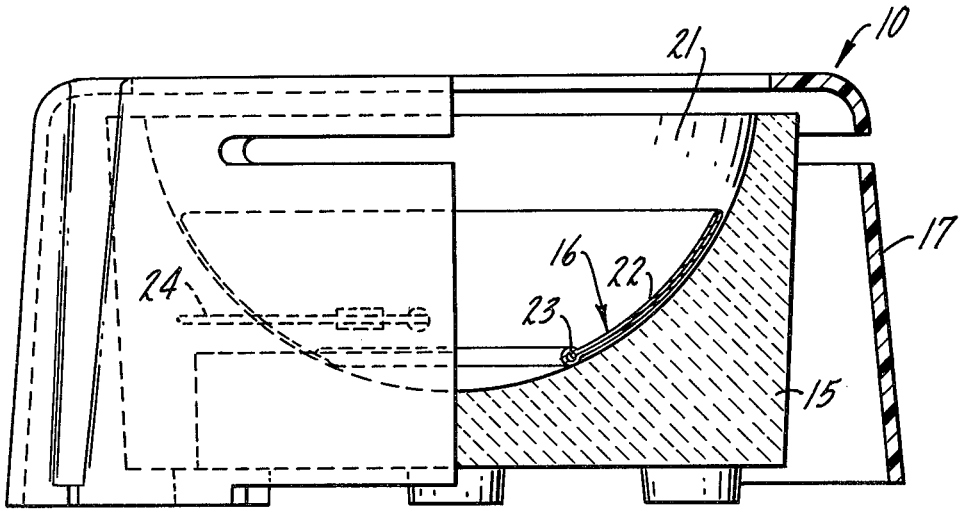
fig. 3.

FLASK HEATER ASSEMBLY

This invention relates to laboratory heaters and more particularly concerns a chemical flask heating assembly.

Spherical bodied chemical flasks, i.e., boiling flasks, are conventionally electrically heated with heating mantles to vaporize their contents. A heating mantle normally takes the form of a fiberglass or asbestos body shaped to snugly receive the flask and which contains a heating coil adapted to be connected to standard 110 volt alternating current. It is the primary aim of the present invention to provide an improved alternative for heating such flasks.

An object of the invention is to provide a flask heating assembly that heats more rapidly and with less power requirements than prior heating mantles. Another object is to provide such an assembly that is highly responsive to thermostatic control, having little thermal mass, so that good temperature control can be obtained.

A further object is to provide an assembly as characterized above that is safer than present heating mantles in that the assembly is isolated from the normal 110 volt current, does not run "red hot", and is not porous so as to soak up spilled or splashed liquids.

Yet another object is to provide a heating assembly of the above character that is also economical to manufacture.

Other objects and advantages of the invention will become apparent upon reading the following detailed description and upon reference to the drawings, in which:

FIG. 2 is an enlarged top plan of the heating assembly shown in FIG. 1;

FIG. 3 is a partial vertical section of the assembly shown in FIG. 2; and

Figure 1:
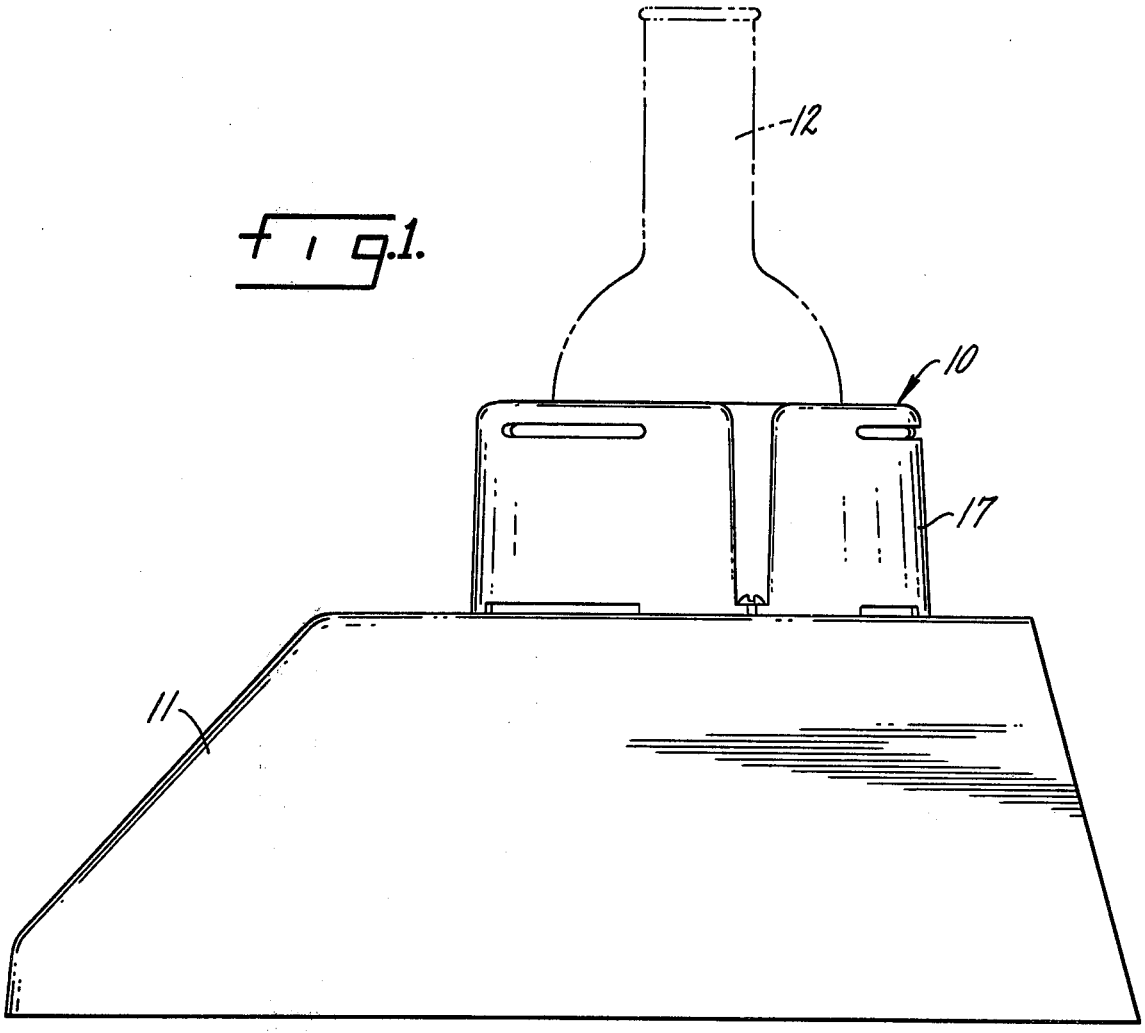
FIG. 1 is a side elevation of a heating assembly embodying the invention in which a flask, shown in phantom lines, is seated.

While the invention will be described in connection with a preferred embodiment, it will be understood that I do not intend to limit the invention to that embodiment. On the contrary, I intend to cover all alternatives, modifications and equivalents as may be included within the spirit and scope of the invention as defined by the appended claims.

Turning now to the drawings, there is shown a flask heating assembly 10 mounted on a base 11 and adapted to quickly and efficiently heat the contents of a spherical bodied, i.e., boiling, flask 12. The assembly 10 includes a block 15 and an electrical resistance heated element 16 which, in the illustrated case, are fitted within a generally cylindrical housing 17 mounted on the base 11.

Figure 4:
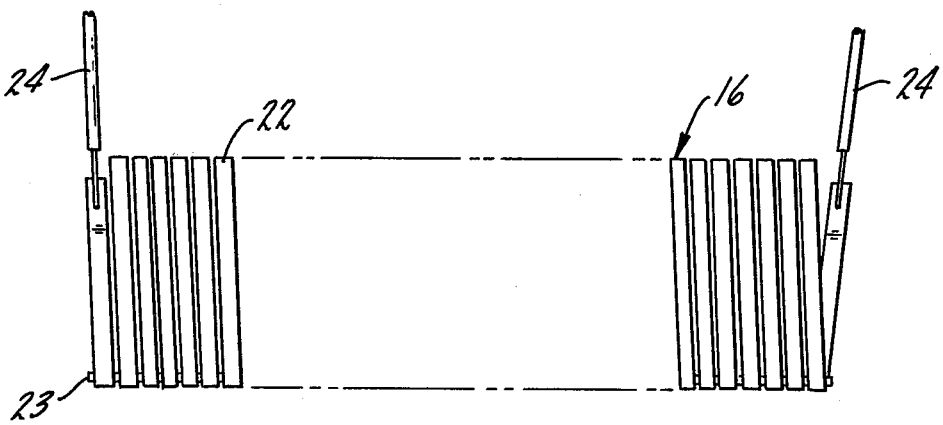
FIG. 4 is the heating element embodied in the FIG. 1 assembly in an initial state of manufacture.

In accordance with the invention, the block 15 has a hollow 21 contoured to receive the body of the flask 12 and the resistance heated element 16 is a flat ribbon folded in overlapping, offset zig-zagged fashion to define an elongated flat band of overlapped ribbon (see FIG. 4) which is then bent into an approximate circle and fitted in the block hollow 21 so as to conform with the complementary shapes of the hollow and the flask body. Obviously, the ribbon defining the element 16 is of the common resistance type whose surfaces are normally coated with an electrically insulating layer such as a metallic oxide. Preferably, the block 15 is formed of fire brick and the element 16 is formed of a metal ribbon 22 about 0.03 inches thick and $\frac{1}{8}$ inch wide. The metal may be a chromium nickel alloy common to electrical heating elements.

To hold the bent configuration of the ribbon, the ribbon is preferably fitted over a wire 23 at one edge of the band (see FIG. 4) and then the wire is formed into a substantial circle to define the inner or lower edge of the ribbon band (see FIG. 2). The upper or outer ends of the ribbon band are left free, and the flexibility of each fold of the ribbon 22 insures good conforming contact between the flask and the heating element 16.

In the illustrated assembly, the ribbon 22, shaped for an approximately 4" diameter flask, will have an electrical resistance of about 2.7 ohms. By applying approximately 20 volts alternating current through leads 24 to the opposite ends of the ribbon 22, a temperature of approximately 400° C. will be quickly attained. This is still about 100° C. below the temperature that would cause the ribbon to glow, and the reduced voltage at the heating element also produces a safer assembly.

Nevertheless, the ribbon 22 quickly and efficiently heats the flask 12 since it is in direct contact with the body of the flask. Also, the thin ribbon possesses little thermal mass so that if thermostatic control is desired, there is little lag or inertia in operation. That is, the ribbon quickly heats when current is applied, and quickly cools when it is cut off.

Those skilled in this art will also appreciate that the assembly 10 can be economically produced. In comparing the assembly 10 with conventional heating mantles, it will be noted that porous, liquid retaining bodies have been avoided, there is no full 110 line voltage at the heating element, and heat at a desired temperature is efficiently applied to a flask with much lower power consumption.

I claim as my invention:

1. An electrical heating assembly for a flask having a liquid holding, substantially spherical body, the combination comprising, a heat resisting block having a semicircular hollow contoured to receive said flask body, a flat ribbon of electrical resistance heated, flexible metal folded in overlapping, offset zig-zag fashion to define an elongated flat band of overlapped ribbon that is bent into an approximate circle and fitted in said hollow so as to conform with the shape of both said hollow and said flask body, said ribbon having an outer electrically insulating layer, means for electrically coupling the ends of said ribbon to a source of electrical current so as to heat said ribbon and a flask in contact with said ribbon, said bent and fitted ribbon defining a band closely and resiliently fitted against a lower band-like portion of a flask body, and said ribbon being folded over a wire at one edge of said band with said wire being formed in a substantial circle to hold the bent and fitted ribbon in substantially circular position.

* * * * *